United States Patent [19]

Zunkel

[11] Patent Number: 4,619,325

[45] Date of Patent: Oct. 28, 1986

[54] WELL SURGING METHOD AND SYSTEM

[75] Inventor: Gary D. Zunkel, Chickasha, Okla.

[73] Assignee: Halliburton Company, Duncan, Okla.

[21] Appl. No.: 696,240

[22] Filed: Jan. 29, 1985

[51] Int. Cl.[4] ..... E21B 34/10; E21B 37/08

[52] U.S. Cl. ..... 166/374; 166/319; 166/386; 166/387

[58] Field of Search ..... 166/264, 373, 374, 386, 166/387, 319, 323, 311, 133, 188

[56] References Cited

U.S. PATENT DOCUMENTS

| | | | |
|---|---|---|---|
| 4,044,829 | 8/1977 | Jessup et al. | 166/264 |
| 4,047,564 | 9/1977 | Nix et al. | 166/72 |
| 4,059,153 | 11/1977 | Nix et al. | 166/264 |
| 4,063,593 | 12/1977 | Jessup | 166/264 X |
| 4,064,937 | 12/1977 | Barrington | 166/321 X |
| 4,076,077 | 2/1978 | Nix et al. | 166/321 X |
| 4,406,328 | 9/1983 | Brooks | 166/332 |
| 4,422,506 | 12/1983 | Beck | 166/324 |
| 4,429,748 | 2/1984 | Beck | 166/324 |
| 4,553,598 | 11/1985 | Meek et al. | 166/264 |

FOREIGN PATENT DOCUMENTS 2132250 7/1984 United Kingdom .

*Primary Examiner*—Stephen J. Novosad
*Attorney, Agent, or Firm*—James R. Duzan

[57] ABSTRACT

A well surging system includes an elongated housing assembly having a central flow bore therethrough. Upper and lower independently operable ball valves are disposed in the housing assembly. Each of the ball valves is movable between a closed position and an open position. When the ball valves are in an initial closed position, a low pressure surge chamber is defined therebetween, which surge chamber is a portion of the flow bore. A packer is connected to the housing assembly for selectively sealing a well annulus between the housing assembly and a well bore so that a well zone below the packer can be surged. The upper and lower ball valves are actuated in response to increases in well annulus pressure through a differential piston arrangement. The lower ball valve is first opened, while the upper ball valve is maintained in a closed position, to allow well fluid from a well zone which is to be surged to surge upward through the flow bore past the opened lower ball valve into the surge chamber. Subsequently, the upper ball valve is opened allowing well fluid in the surge chamber to be circulated upward through a bore of a tubing string connected to the apparatus.

15 Claims, 7 Drawing Figures

WELL SURGING METHOD AND SYSTEM

BACKGROUND OF THE INVENTION

1. Field Of The Invention

The present invention relates to a downhole tool for use in oil or gas wells, or the like. This tool is constructed to perform what is known as a "well surging operation" where formation fluid from a zone of the well is rapidly surged out of the formation and into the well to clean debris away from the inner surfaces of the formation and to clean debris from perforations in the well.

2. Description Of The Prior Art

The prior art includes systems for performing surging operations on a well. These prior art systems generally utilize either rupture discs or flapper-type valves to rapidly replace the producing formation in communication with a low pressure chamber in the tool, so that fluid from the formation will rapidly flow into the tool.

The most commonly used prior art system includes a rupture disc which is ruptured by the thrusting action of a plunger.

Although these prior art techniques produce a dynamic surging effect and acceptable drawdown of the producing formation of the well, the pieces of the disc itself will sometimes clog choke valves and other equipment connected to the well after the disc is ruptured. Such a condition most often occurs when the disc does not shatter into fine enough pieces to be circulated out of the well.

Another unfavorable condition that sometimes occurs with these prior art systems is when the disc itself does not completely detach, and instead acts somewhat as a flapper valve in the inner bore of the drill pipe. Under that circumstance, difficulties are presented in circulating fluid upward through the drill pipe, due to the flapper valve effect of the partially severed ruptured disc. In such situations, the less desirable method of circulating fluids up through the well annulus has to be utilized.

Additionally, the materials, such as aluminum, from which the rupture discs are often constructed are not totally reliable when utilized in corrosive environments. Actions of corrosives weaken the rupture discs and quite often operators experience premature rupturing of the disc.

Thus, there has been a need in the prior art for a well surging system which could provide rapid communication of the well zone with the low pressure chamber, so as to achieve the required rapid surging of fluid from the well zone into the low pressure chamber, and yet avoiding the various problems pointed out above with rupture disc type systems.

SUMMARY OF THE INVENTION

The well surging system of the present invention includes an elongated housing assembly having a central flow bore disposed therethrough.

Upper and lower independently operable ball valves are disposed in the housing assembly. Each of the ball valves are independently movable between a closed position wherein the flow bore is closed and an open position wherein the flow bore is open. The upper and lower ball valves define a low pressure surge chamber therebetween when the ball valves are in an initially closed position. This surge chamber is actually a portion of the flow bore.

A packer means is connected to the housing assembly for effectively sealing a well annulus between the housing assembly and a well bore so that a well zone below the packer means may be surged.

A lower ball valve operator means is provided for opening the lower ball valve prior to opening of the upper ball valve means. When the lower ball valve is opened, well fluid from the well zone surges upward through the flow bore of the housing assembly past the opened lower ball valve into the surge chamber.

An upper ball valve operator means is provided for opening the upper ball valve after the lower ball valve has been opened. When the upper ball valve is open, well fluid in the surge chamber may then be circulated upward through a bore of a tubing string connected to the well surging apparatus.

Numerous objects, features and advantages of the present invention will be readily apparent to those skilled in the art upon a review of the following disclosure when taken in conjunction with the accompanying drawings.

DETAILED DESCRIPTION OF THE PREFERRED EMBODIMENTS

Figures 1, 2, 3:
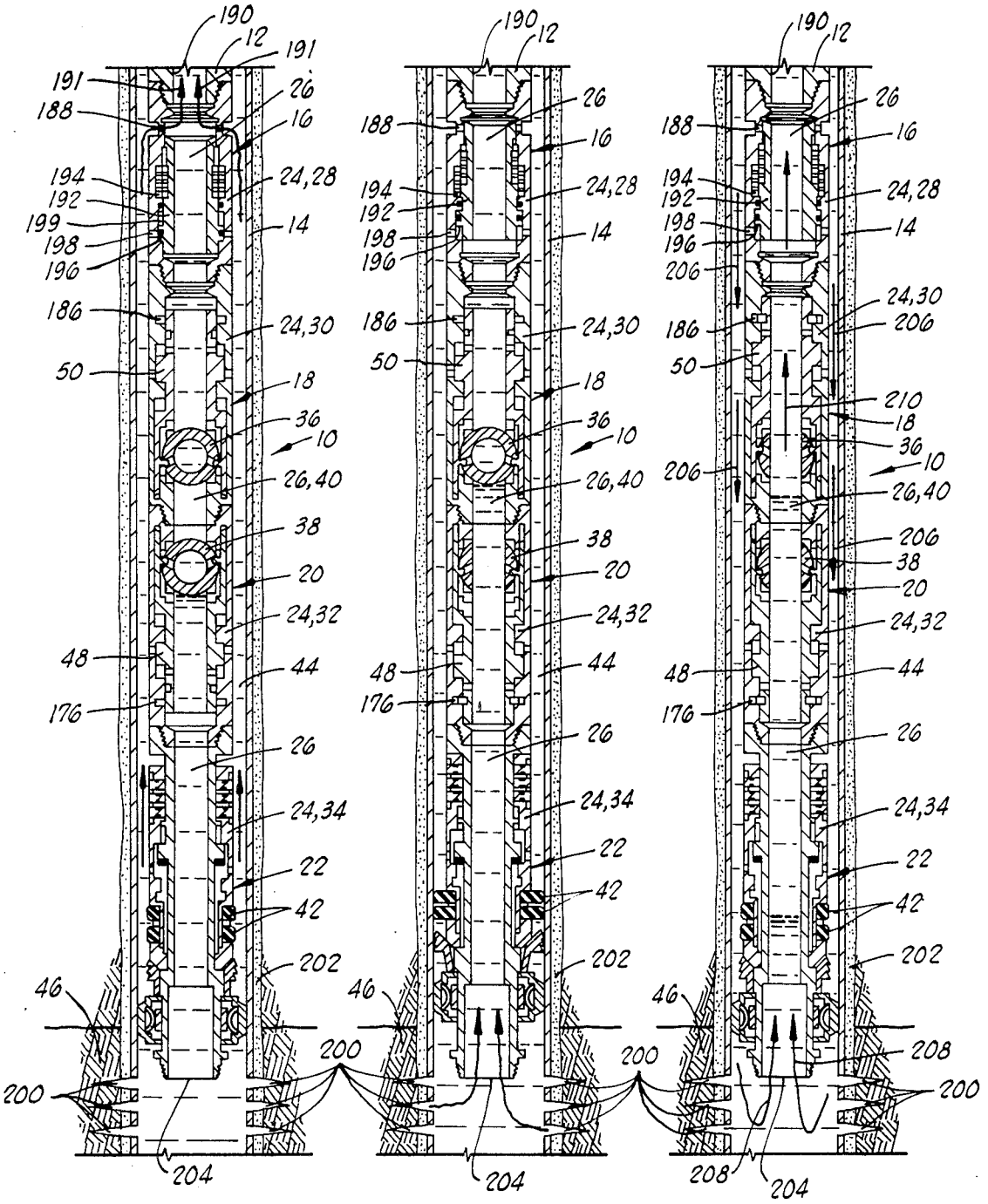
FIG. 1 is a schematic elevation section view of the well surging apparatus of the present invention as it is being lowered into the well.
FIG. 2 is a view similar to FIG. 1 after the packer means has been set and the lower ball valve has been opened so that formation fluid has surged into the surge chamber.
FIG. 3 is a view similar to FIG. 1 showing the upper ball valve in its open position, the packer in its retracted position, and well fluid being circulated up the tubing string.

Referring now to the drawings, and particularly to FIG. 1, the well surging apparatus of the present invention is thereshown and generally designated by the numeral 10.

The apparatus 10 is suspended by a well tubing 12 within a well defined by casing 14. Apparatus 10 includes an upper fill-up valve section 16, and upper ball valve section 18, a lower ball valve section 20, and a packer section 22.

The apparatus 10 includes an elongated housing assembly 24 having a central flow bore 26 disposed therethrough.

Housing assembly 24 includes a fill-up valve housing 28, an upper ball valve housing 30, a lower ball valve housing 32, and a packer section housing 34.

The upper and lower ball valve sections 18 and 20 include upper and lower independently operatable ball valves 36 and 38, respectively, disposed in the housing assembly 24. Each of the ball valves 36 and 38 is independently movable between a closed position as illustrated in FIG. 1 wherein the flow bore 26 is closed and an open position as illustrated in FIG. 3 wherein the flow bore 26 is open.

When the upper and lower ball valves 36 and 38 are in their closed positions as illustrated in FIG. 1, they define a low pressure surge chamber 40 therebetween.

The surge chamber 40 is actually a portion of the flow bore 26.

Although in the schematic illustration of FIG. 1, the upper and lower ball valve sections 18 and 20 are shown directly connected together, any number of stands of spacer tubing may be placed between the upper and lower ball valve sections so that the surge chamber 40 may have a length in the range of 100 to 3,000 feet. Normally, the surge chamber 40 will have a length in the range of 1,000 to 2,000 feet.

The packer section 22 includes an expandable packer means 42 connected to packer section housing 34 of housing assembly 24 for selectively sealing a well annulus 44 between the housing assembly 24 and the well bore defined by casing 14 so that a well zone 46 below the packer means 42 may be surged.

A lower ball valve operator means 48 is provided for opening the lower ball valve 38 prior to opening the upper ball valve 36, in a manner that will be described below.

An upper ball valve operator means 50 is provided for opening the upper ball valve 36 after the lower ball valve 38 has been opened, again in a manner that will be described below.

Referring now to FIGS. 4A–4D, a detailed elevation, rightside only sectioned view of the lower ball valve section 20 is thereshown. The upper ball valve section 18 is similarly constructed but is turned upside down relative to lower ball valve section 20.

The lower ball valve housing 32 includes an upper adapter 52, a ball housing 54, a middle adapter 56, a power section housing 58, and a lower adapter 60.

An upper seat holder mandrel 62 is threadedly connected to upper adapter 52 at threaded connection 64 with a seal being provided therebetween by O-ring 66.

Upper seat holder mandrel 62 includes a plurality of radially outwardly extending splines 68 which are meshed with a plurality of radially inwardly extending splines 70 of ball housing 54 to prevent relative rotational motion therebetween.

An upward facing shoulder 72 of upper seat holder mandrel 62 engages lower ends 74 of splines 70 to hold ball housing 54 in place relative to upper adapter 52. A seal is provided between upper adapter 52 and ball housing 54 by O-ring 76.

Upper seat holder mandrel 62 has an upper annular seat 78 received in a downwardly open counterbore 80 thereof.

Lower ball valve 38 is rotatably held between upper annular seat 78 and a similar lower annular seat 82.

Lower annular seat 82 is received within an upwardly open counterbore 84 of a lower seat holder mandrel 86.

Upper and lower seat holder mandrels 62 and 86 are held in place relative to each other by a plurality of C-clamps such as 88, of which only upper and lower ends 90 and 92 are seen in the drawing.

Lower seat 82 is biased upward against lower ball valve 38 by a single Belleville type spring 94.

The lower ball valve operating means 48 is constructed to be actuated in response to an increase in fluid pressure within the well annulus 44 above the packer means 42 relative to fluid pressure within the flow bore 26. This is accomplished in the following manner.

Lower ball valve operator means 48 includes an actuating mandrel 96 having upper and lower actuating mandrel sections 98 and 100, respectively, which are threadedly connected at 97 with an O-ring seal 99 being provided therebetween.

Lower actuating mandrel section 100 has a power piston 102 defined thereon which is slidably received within a cylindrical bore 104 of power section housing 58.

A lower end 106 of lower actuating mandrel section 100 is slidably received within a bore 108 of lower adapter 60.

Power piston 102 includes piston seals 110 sealing between power piston 102 and bore 104.

Lower actuating mandrel section 100 has a plurality of ports 112 disposed therethrough placing a lower side 114 of power piston 102 in communication with the flow bore 26 below the lower ball valve 38.

An upper side 116 of power piston 102 is communicated with the well annulus 44 through a power port 118 disposed through the wall of power section housing 58.

The outside diameter of power piston 102 is defined by seals 110 engaged with bore 104, and the inside diameter of annular power piston 102 is defined by O-ring 120 which are contained in a radially inner groove 122 of middle adapter 56, and which engage an outer diameter 124 of upper actuating mandrel section 98.

Thus, any pressure differential between the well annulus 44 and the flow bore 26 will act across the power piston 102.

Upper actuating mandrel section 98 includes a plurality of radially outward extending splines 126 which are meshed with a pluralityof radially inward extending splines 128 of middle adapter 56 to prevent relative rotation therebetween.

A threaded cap 130 is connected to the upper end of upper actuating mandrel section 98 at threaded connection 132.

An upper portion of outer cylindrical surface 124 of upper actuating mandrel section 98 is slidably received within a bore 134 of an actuating ring 136, with a seal being provided therebetween by O-ring 138.

An outer surface 139 of actuating ring 136 is closely received within a bore 141 of ball housing 54 with a sliding seal being provided therebetween by O-ring 143.

Actuating ring 136 is connected to a cylindrical actuating sleeve 140 at threaded connection 142.

The threaded cap 130 is closely received within a bore 144 of actuating sleeve 140, and is vertically trapped between a downward facing tapered surface 146 of actuating sleeve 140 and an upper end 148 of actuating ring 136.

Thus, vertical motion of actuating mandrel 96 due to forces exerted on power piston 102 is transferred to actuating ring 136 and actuating sleeve 140.

Actuating sleeve 140 has an upper bore 150 within which is closely received an outer cylindrical surface 152 of lower seat holder mandrel 86, with a seal being provided therebetween by O-ring 154.

Cylindrical actuating sleeve 140 has a radially outer annular groove 156 disposed in its upper end portion.

An actuating arm 158 has a radially inward extending lower flange 160 which is received within groove 156 of actuating sleeve 140.

Actuating arm 158 is a longitudinal member, being arcuate in cross section, and slides in a longitudinal space 162 between the ball housing 54 and each of the upper seat holder mandrel 62, lower ball valve 38, and lower seat holder mandrel 86.

There is a second actuating arm such as actuating arm 158, which is circumferentially located from the first actuating arm 158 and which is not seen in the drawing.

An actuating lug 164 extends radially inward from actuating arm 158 and is received within an eccentric bore 166 disposed through the wall of lower ball valve 38.

Figure 4A:
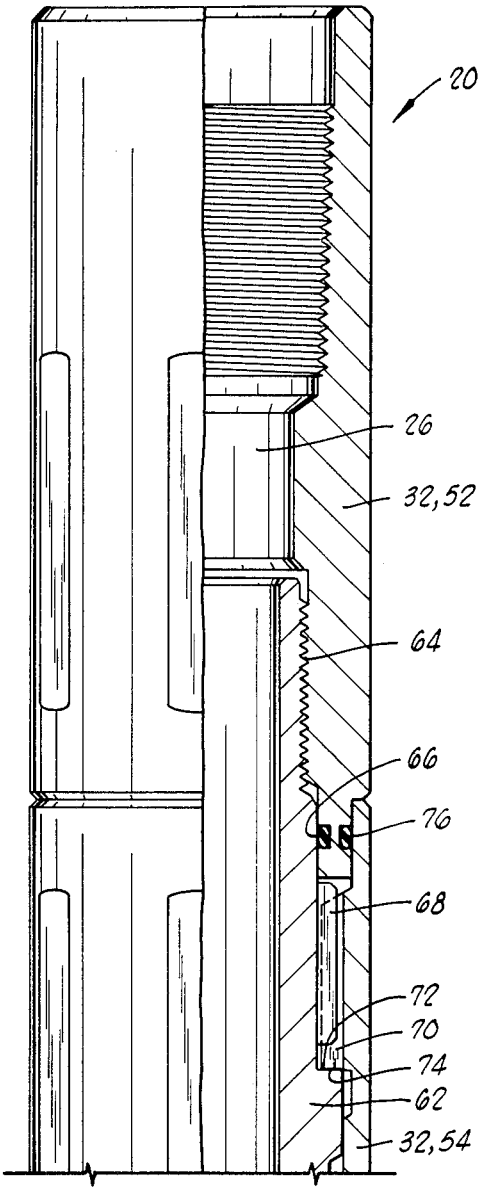
FIGS. 4A–4D comprise an elevation right-side only section view of the lower ball valve assembly of the apparatus of FIG. 1.
Figure 4B:
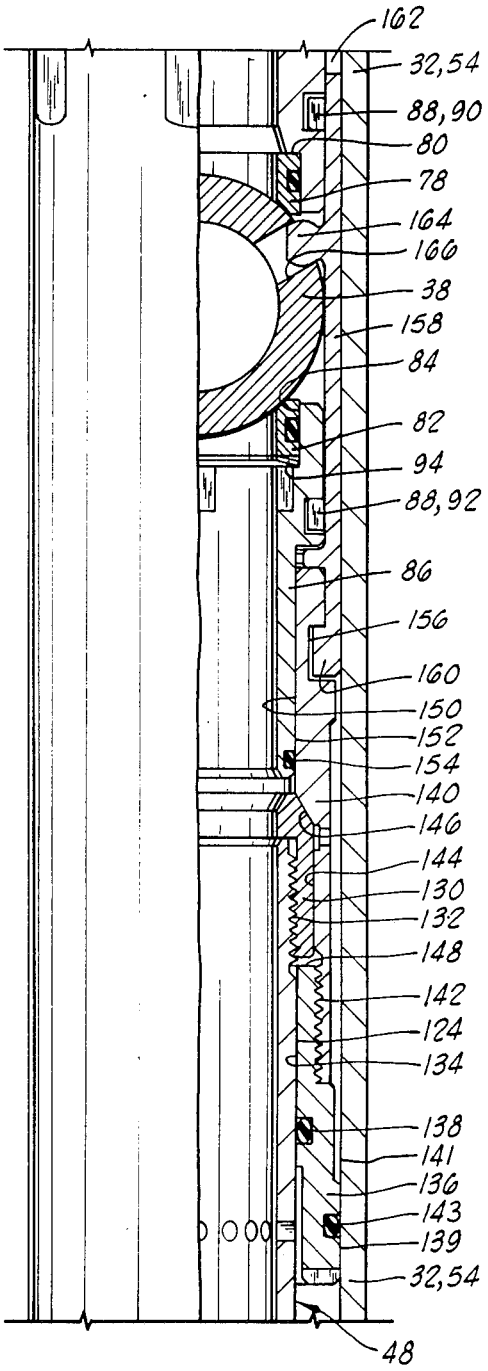
Figure 4C:
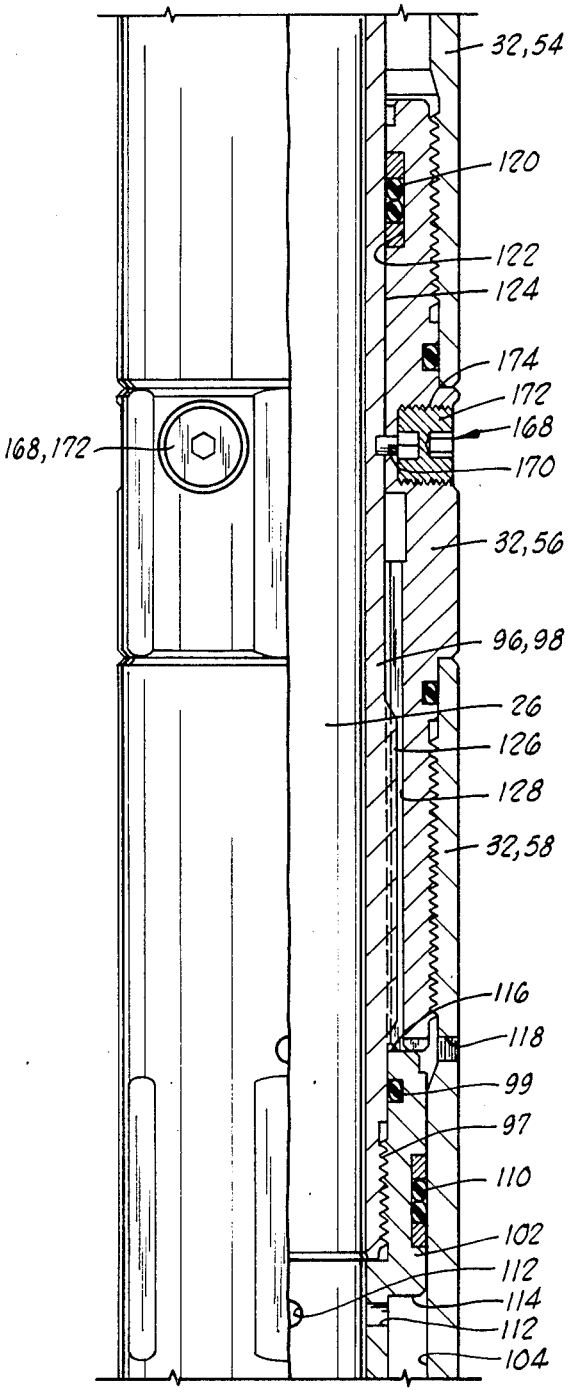
Figure 4D:
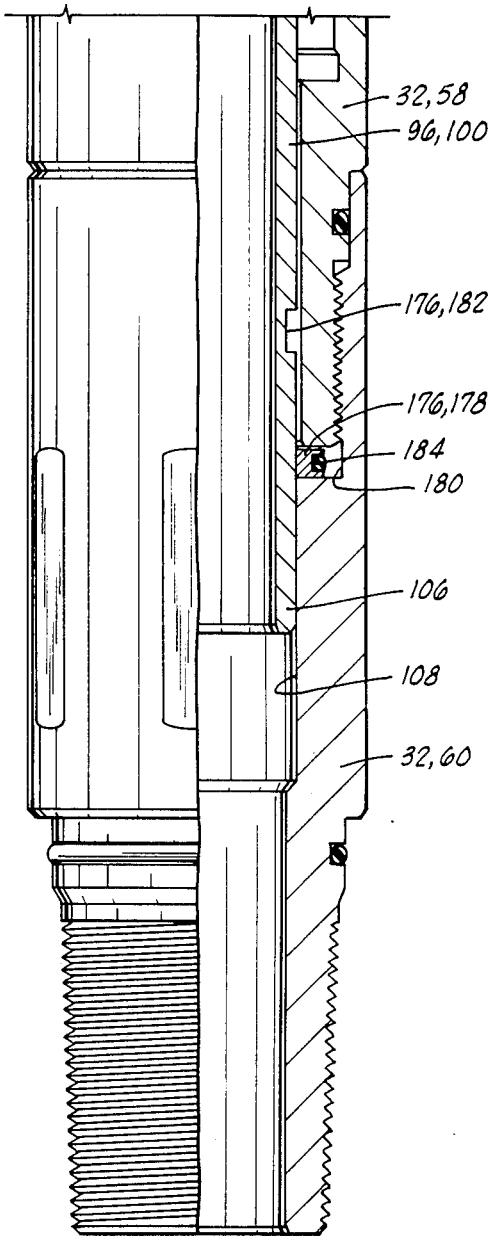

When actuating mandrel 96 is moved downward relative to lower ball valve housing 32 due to downward forces acting on power piston 102, in a manner that will be further described below, the actuating arm 158 moves downward relative to lower ball valve 38 and actuating lug 164 rotates lower ball valve 38 from its closed position as shown in FIG. 4B to an open position like that schematically illustrated in FIGS. 2 and 3.

The lower ball valve housing section 20 includes a lower releasable retaining means 168 operably associated with the lower ball valve opeator means 48 for releasably retaining the lower ball valve 38 in its initial closed position as shown in FIG. 4B until fluid pressure in the well annulus 44 exceeds fluid pressure in the flow bore 26 below the lower ball valve 38 by a first predetermined pressure differential.

Lower releasable retaining means 168 includes a plurality of lower shear pins, such as pin 170 which is disposed between middle adapter 56 of lower ball valve housing 32 of housing assembly 24 and upper actuating mandrel section 98 of actuating mandrel 96 of lower ball valve operator means 48.

Each of the lower shear pins 170 is held in place by a cylindrical radially oriented shear pin holder 172 which is threadedly received at threaded connection 174 within a radial bore of middle adapter 56.

As will be understood by those skilled in the art, the pressure differential between well annulus 44 and the flow bore 26 below lower ball valve 38 required to shear the shear pins 170 depends on the number, material, and size of the shear pins 170.

The upper ball valve section 18, as previously mentioned, is constructed in the identical fashion of lower ball valve housing section 20 except that it is inverted relative to the orientation of lower ball valve housing section 20. It also, therefore, includes shear pins such as the shear pins 170.

The lower ball valve section 20 also includes a lower locking means 176 operably associated with the lower ball valve operator means 48 for locking the lower ball valve 38 in its open position to prevent reclosure of the lower ball valve 38.

Lower locking means 176 includes a plurality of radially inwardly resiliently biased locking dogs such as 178 received in a radially inner groove 180 of lower ball valve housing 32 and arranged to engage a radially outer groove 182 of lower actuating mandrel section 100 when the lower ball valve 38 is in its open position. An annular resilient band 184 encircles dogs 178 to bias them radially inward.

Referring again to FIG. 1, the upper ball valve section 18 includes an upper locking means 186 constructed in a manner like that of lower locking means 176 just described.

MANNER OF OPERATION OF WELL SURGING SYSTEM

FIG. 1 illustrates the well surging apparatus 10 in its initial orientation as it is being lowered into the well defined by well casing 14.

The apparatus 10 is initially oriented so that the upper and lower ball valves 36 and 38 are in their closed positions as illustrated in FIG. 1, thus defining the surge chamber 40 therebetween. The surge chamber 40 is initially filled with ambient air at atmospheric pressure, and thus provides a relatively low pressure chamber as compared to the hydrostatic well fluid pressures within the well and as compared to the pressures of formation fluid within the zone 46 of the well.

Also, in the initial orientation of apparatus 10, the expandable packer means 42 of packer section 22 is in a retracted position as illustrated in FIG. 1 so that the apparatus 10 may be lowered in to the well.

As previously mentioned, the apparatus 10 includes a fill-up valve section 16 located above the upper ball valve section 18.

The fill-up valve section 16 includes a plurality of radial ports such as 188 which communicate the well annulus 44 with the flow bore 26.

The fill-up valve 16 is initially in an open position as illustrated in FIG. 1, when the apparatus 10 is being lowered into the well.

This permits well fluid from the annulus 44 to flow into the flow bore 26 as indicated by arrows 191 and into a tubing bore 190 of tubing string 12 so as to fill up the tubing string as the apparatus 10 is lowered into the well.

The fill-up valve apparatus 16 includes the fill-up valve housing 28 previously mentioned, and a concentric inner sliding valve sleeve 192. The valve sleeve 192 is initially held in the open position relative to fill-up valve housing 28 as shown in FIG. 1 by a shear pin set 194.

A differential pressure actuating piston 196 is defined upon valve sleeve 192 and slides within an inner bore of fill-up valve housing 28.

A power port 198 disposed through fill-up valve housing 28 communicates the well annulus 44 with the lower side of the actuating piston 196. The upper side of the actuating piston 196 is communicated with a sealed low pressure chamber 199.

Thus, when the upward pressure differential acting across actuating piston 196 reaches a predetermined value, which is determined by the construction of shear pin set 194, the shear pin set 194 will shear allowing the valve sleeve 192 to move upward to a closed position closing the ports 188, as illustrated in FIGS. 2 and 3.

The fill-up valve section 16 may be constructed so as to have the ports 188 close at a predetermined depth within the well by designing the shear pin set 194 to shear at the hydrostatic pressure in well annulus 44 corresponding to that predetermined depth, or the fill-up valve section may be constructed so that additional pressure will need to be provided to well annulus 44 to shear the shear pin set 194.

In any regard, as the well surging apparatus 10 is initially lowered into the well as shown in FIG. 1, the ports 188 of the fill-up valve section will be maintained open until the apparatus 10 is located in substantially its final desired position.

As the apparatus 10 is lowered into the well, the upper and lower ball valves 36 and 38 are releasably retained in their initial closed portions as shown in FIG. 1 by the releasable retaining means such as 168 including shear pins such as 170.

In FIG. 1, the well surging apparatus 10 is shown as having been replaced at a desired final location such that the expandable packer means 42 is located at an elevation above the zone 46 which is to be surged.

FIG. 1 schematically illustrates a plurality of perforations 200 which have been created through the well casing 14, through a cement sheath 202 surrounding the well casing 14, and into the formation 46 itself, in a manner that is well known to those skilled in the art.

The purpose of the well surging operation is primarily to clean the perforations 200 of the debris that is created when the perforations 200 are initially formed.

As is apparent in FIG. 1, the zone 46 is communicated through the perforations 200 with the flow bore 26 through an open lower end 204 of packer section 22. The fluid from formation 46 is separated from the low pressure surge chamber 40 by the closed lower ball valve 38.

After the well surging apparatus 10 is located at its desired final position as illustrated in FIG. 1, the expandable packer means 42 is set as illustrated in FIG. 2 to seal the well annulus 44 at an elevation above the zone 46.

The packer section 22 is of a conventional design well known to those skilled in the art, and is set by slightly rotating the apparatus 10 to actuate a J-slot mechanism and then by setting down weight on the tubing strong 12 and the apparatus 10 to cause the expandable packer means 44 to be compressed longitudinally and thus expanded radially outward as schematically illustrated in FIG. 2.

Subsequent to setting the expandable packer means 42 as illustrated in FIG. 2, the zone 46 of the well can be surged by opening the lower ball valve means 38 to allow fluid from the formation 46 to rapidly surge into the low pressure surge chamber 40.

It is necessary that the lower ball valve means 38 be opened without opening the ball valve means 36.

The opening of the lower ball valve means 38 is preferably accomplished in the following manner.

As previously described with regard to FIGS. 4A–4D, the upper and lower ball valve sections 18 and 20 are constructed so that the upper and lower ball valves 36 and 38 are opened in response to an increase in pressure within the well annulus 44 relative to the flow bore 26. This increase in differential pressure is applied across power pistons such as power piston 102 to shear shear pins such as 170 and to rotate the ball valves to their open positions.

Preferably, the upper and lower ball valve sections 18 and 20 are constructed to be opened at substantially equal differential pressures across their respective power pistons.

This, however, requires that a particular procedure be utilized to prevent application of differential pressure across the power piston of the upper ball valve section 18, while applying a differential pressure across the power piston of the lower ball valve section 20. This is accomplished in the following manner.

As previously mentioned, the fill-up valve section 16 is moved to a closed position as illustrated in FIG. 2 wherein the ports 188 are closed by valve sleeve 192, prior to opening either of the upper and lower ball valves 36 and 38.

Then, the fluid in tubing bore 190 and in flow bore 26 above the closed upper ball valve 36 is pressurized to a pressure sufficient to prevent opening of the ball valve 36 when the lower ball valve 38 is subsequently actuated and opened.

The shear pins such as 170 of the upper and lower ball valve sections 18 and 20 are designed to be sheared at a differential pressure across their respective power pistons in the range of 1,000 to 1,500 psi.

Thus, to initially prevent operation of the upper ball valve 36 while the lower ball valve 38 is being opened, the fluid within tubing bore 190 and in flow bore 26 above the upper ball valve 36 is preferably initially pressurized to approximately 1,500 psi above hydrostatic pressure.

It should be remembered that the pressure in flow bore 26 below lower ball valve 38 will still be at substantially hydrostatic pressure.

Then, the pressure in well annulus 44 above the expanded packer means 42 is increased to approximately 1,500 psi above hydrostatic pressure.

Since the pressure in flow bore 26 below lower ball valve means 38 is stil at hydrostatic pressure, this will apply a downward pressure differential of 1,500 psi across the power piston 102 of lower ball valve section 20, thus causing the shear pins 170 thereof to shear and allowing the actuating mandrel 96 to be moved downwardly thus rotating the lower ball valve 38 to its open position as illustrated in FIG. 2.

Throughout this operation, the pressure within tubing bore 190 and within flow bore 26 above upper ball valve 36 is maintained at an increased pressure of approximately 1,500 psi above hydrostatic pressure, so that there will be no substantial pressure differential across the power piston of upper ball valve section 18.

Once the lower ball valve 38 is rotated to its open position, which will occur very rapidly upon shearing of the shear pins 170, well fluid from the zone 46 will rapidly surge inward through the perforations 200 into the open lower end 204 of packer section 22, upward through the flow bore 26 past the opened lower ball valve 38 and into the low pressure surge chamber 40. This very rapid fluid flow through the perforations 200 will cause debris located in those perforations and adjacent the faces of the producing formation to be swept out of the perforations 200, thus ultimately significantly increasing the producing capabilities of the well.

Often, after the lower ball valve 38 has been opened to surge the well, the upper ball valve 36 will be maintained in its closed position for a period of time of perhaps one hour.

Then, the upper ball valve 36 is opened. The upper ball valve 36 is opened by creating a pressure differential across the power piston of the upper ball valve section 18, which, as previously mentioned, is constructed identically to the lower ball valve section 20 of FIGS. 4A–4D, except that it is turned upside down.

The increased pressure which was previously applied to the flow bore 26 above the upper ball valve 36 is released. Then the well annulus 44 is pressurized to a pressure approximately 1,500 psi above the hydrostatic pressure within the flow bore 26 above upper ball valve 36, thus shearing the shear pins such as 170 of the upper ball valve section 18, to rotate the upper ball valve 36 to its open position as illustrated in FIG. 3.

Then, the expandable packer means 42 is released as illustrated in FIG. 3. This is accomplished by relieving the pressure from the well annulus 44 and picking up on the tubing string 12 and well surging apparatus 10 to cause the packer means 42 to retract as shown in FIG. 3.

Then, the well fluid contained in the surge chamber 40 and in the flow bore 26 and tubing bore 190 is circulated upward through the tubing bore 190 by pumping fluid downward through the well annulus 44 as indicated by the arrows 206. This fluid enters the lower end 204 of packer section 22 as indicated by arrows 208 and the fluid flows upward through the flow bore 26 as indicated by arrows 210.

The upper and lower ball valves 36 and 38 are locked in their open positions by the upper and lower locking means 186 and 176, respectively, to prevent reclosure of those ball valves.

A number of advantages are provided by the system of the present invention as compared to prior art systems utilizing flapper valves and disc valves.

There is no debris created from actuation of the surge tool, since the tool is actuated merely by rotating a ball valve and there is no disc which is ruptured.

The rapid opening ability of the ball valve provides almost instantaneous surging of the fluid from the zone of the well.

The ball valve structure is very reliable in its opening capabilities.

The ball valve structure provides a large internal diameter allowing ample flow area for rapid recovery of fluid from the well.

With the ball valve arrangement, well fluid can always be circulated out upward through the tubing string, rather than having to utilize the well annulus for circulating as is sometimes the case when using disc-type valves.

Additionally, the annulus pressure responsive ball valves having the shear pins initially holding the ball valves closed and having the rapid instantaneous movement achieved when the pin is sheared provide a reliable indication at the surface that the tool has opened.

Thus it is seen that the methods and apparatus of the present invention readily achieve the ends and advantages mentioned as well as those inherent therein. While certain preferred embodiments of the present invention have been illustrated for purposes of the present disclosure, numerous changes in the arrangement and construction of parts and steps may be made by those skilled in the art which changes are embodied within the scope and spirit of the present invention as defined by the appended claims.

What is claimed is:

1. A method of surging a well, said method comprising the steps of:

(a) providing a tool string including upper and lower spaced ball valves and a packer;

(b) initially orienting said tool string so that said ball valves are closed to define a surge chamber therebetween, and so that said packer is in a retracted position;

(c) placing said tool string as initially oriented in step (b) in a well so that said packer is located at an elevation above a zone of said well which is to be surged;

(d) setting said packer to seal a well annulus between said tool string and said well at said elevation above said zone;

(e) after step (d), opening said lower ball valve; and thereby (f) surging fluid from said zone of said well up through said tool string past said opened lower ball valve and into said surge chamber.

2. The method of claim 1, wherein:

said method further includes the step of:

(g) opening said upper ball valve; and said steps (e) and (g) of opening said lower and upper ball valves, respectively, are each accomplished by increasing well fluid pressure in said well annulus.

3. The method of claim 2, wherein:

said step (a) is further characterized in that said upper and lower ball valves are each annulus pressure responsive ball valves and are constructed to be actuated at approximately the same differential pressure between the well annulus and an inner bore of said tool string; and said steps (e) and (g) are accomplished by:

prior to step (e), pressurizing well fluid in said inner bore of said tool string above said closed upper ball valve to a pressure sufficient to prevent opening of said upper ball valve when said lower ball valve is actuated;

then, increasing well annulus pressure to actuate and open said lower ball valve thus accomplishing step (e) while maintaining pressure in said inner bore of said tool string above said upper ball valve;

after step (e), relieving pressure from said well fluid in said inner bore of said tool string above said upper ball valve; and then, again increasing well annulus pressure to open said upper ball valve thus accomplishing step (g).

4. The method of claim 3, further comprising, subsequent to step (g) the steps of:

(h) releasing said packer; and (i) circulating well fluid from said surge chamber upward through said tubing string by pumping well fluid down said well annulus.

5. The method of claim 4, wherein:

said step (h) of releasing said packer is accomplished by:

relieving pressure from said well annulus subsequent to opening said upper ball valve; and then picking up on said tool string to release said packer.

6. The method of claim 2, further comprising the steps of:

prior to steps (e) and (g), releasably retaining said lower and upper ball valves, respectively, in their initially closed positions; and subsequent to steps (e) and (g), locking said lower and upper ball valves, respectively, in their open positions to prevent subsequent reclosure of said ball valves.

7. The method of claim 1, wherein said step (a) is further characterized in that said tool string further includes a fill-up valve located above said upper ball valve;

said step (b) is further characterized in that said fill-up valve is initially oriented in an open position; and said method further includes the steps of:

during step (c), filling a tubing bore of a tubing string located above said tool string with well fluid through said open fill-up valve; and prior to step (e), closing said fill-up valve.

8. The method of claim 1, wherein:

said step (b) is further characterized in that said surge chamber is initially filled with compressible gas at substantially atmospheric pressure.

9. A well surging apparatus, comprising:

an elongated housing assembly having a central flow bore disposed therethrough;

upper and lower independently operable ball valves disposed in said housing assembly, each of said ball valves being independently movable between a closed position wherein said flow bore is closed and an open position wherein said flow bore is open, said upper and lower ball valves defining a low pressure surge chamber therebetween when said ball valves are in an initially closed position, said surge chamber being a portion of said flow bore;

packer means, connected to said housing assembly for selectively sealing a well annulus between said housing assembly and a well bore so that a well zone below said packer means may be surged;

lower ball valve operator means for opening said lower ball valve prior to opening of said upper ball valve means, so that well fluid from said well zone may surge upward through said flow bore past said opened lower ball valve into said surge chamber; and upper ball valve operator means for opening said upper ball valve after said lower ball valve has been opened, and for thereby allowing well fluid in said surge chamber to be circulated upward through a bore of a tubing string connected to said apparatus wherein said lower and upper ball valve operator means are each constructed to be actuated in response to an increase in fluid pressure in said well annulus above said packer means relative to fluid pressure within said flow bore.

10. The apparatus of claim 9, further comprising:

lower releasable retaining means, operably associated with said lower ball valve operator means, for releasably retaining said lower ball valve in its initial closed position until fluid pressure in said well annulus above said packer means exceeds fluid pressure in said flow bore below said lower ball valve by a first predetermined pressure differential; and upper releasable retaining means, operably associated with said upper ball valve operator means, for releasably retaining said upper ball valve in its initial closed position until fluid pressure in said well annulus above said packer means exceeds fluid pressure in said flow bore above said upper ball valve by a second predetermined pressure differential.

11. The apparatus of claim 11, wherein:

said second predetermined pressure differential is approximately the same as said first predetermined pressure differential.

12. The apparatus of claim 10, wherein:

said lower and upper releasable retaining means include lower and upper shear pins disposed between said housing assembly and said lower and upper ball valve operator means, respectively.

13. The apparatus of claim 10, further comprising:

lower and upper locking means, operably associated with said lower and upper ball valve operator means, respectively, for locking said lower and upper ball valves in their respective open positions to prevent reclosure of said ball valves.

14. The apparatus of claim 13, wherein:

said lower locking means includes a plurality of radially inwardly resiliently biased locking dogs received in a radially inner groove of said housing assembly and arranged to engage a radially outer groove of said lower ball valve operator means when said lower ball valve is in its said open position.

15. The apparatus of claim 9, further comprising:

selectively closeable fill-up valve means, disposed through a wall of said housing assembly above said upper ball valve, for filling said bore of said tubing string when said apparatus is lowered into said well bore.

* * * * *